US008302827B1

(12) United States Patent
Cole

(10) Patent No.: US 8,302,827 B1
(45) Date of Patent: Nov. 6, 2012

(54) ONE SIDED HOLSTER

(76) Inventor: Tod L. Cole, Nashville, TN (US)

( * ) Notice: Subject to any disclaimer, the term of this patent is extended or adjusted under 35 U.S.C. 154(b) by 512 days.

(21) Appl. No.: 12/397,621

(22) Filed: Mar. 4, 2009

Related U.S. Application Data

(60) Provisional application No. 61/042,248, filed on Apr. 3, 2008.

(51) Int. Cl.
*F41C 33/02* (2006.01)

(52) U.S. Cl. ..... 224/243; 224/587

(58) Field of Classification Search ..... 224/587, 224/243
See application file for complete search history.

(56) References Cited

U.S. PATENT DOCUMENTS

| | | | | |
|---|---|---|---|---|
| 309,292 | A | 12/1884 | Browne | |
| 814,599 | A | 3/1906 | Freyer | |
| 3,713,239 | A | 1/1973 | Sperling | |
| 3,804,306 | A * | 4/1974 | Azurin | 224/193 |
| 4,410,118 | A * | 10/1983 | Taurisano | 224/222 |
| 4,450,992 | A * | 5/1984 | Casull | 224/163 |
| 4,577,787 | A * | 3/1986 | Hersey | 224/243 |
| 4,852,286 | A | 8/1989 | Troncoso et al. | |
| 4,858,800 | A * | 8/1989 | Holtzclaw et al. | 224/243 |
| 5,209,383 | A | 5/1993 | Theodore | |
| 5,909,834 | A * | 6/1999 | Parrott, III | 224/587 |
| 6,604,657 | B2 * | 8/2003 | Yirmiyahu et al. | 224/243 |
| 2009/0321480 | A1 * | 12/2009 | Kincaid et al. | 224/243 |

OTHER PUBLICATIONS

Exhibit A: 6 page printout from www.artofthehide.com (undated but admitted to be prior art).

* cited by examiner

*Primary Examiner* — Brian D Nash
(74) *Attorney, Agent, or Firm* — Waddey & Patterson, P.C.; Lucian Wayne Beavers; Mark Andrew Pitchford

(57) ABSTRACT

A holster apparatus includes a taller outside and a shorter inside panel joined together to form a shallow bottom pocket. The holster apparatus is generally open to the inside. The outside of the holster apparatus substantially completely covers the handgun so that the holster apparatus and handgun may be carried in a user's pocket and give the general appearance of a wallet carried within the pocket. The handgun is not discernible to a viewer when the handgun and holster are carried in the user's pocket.

21 Claims, 4 Drawing Sheets

ONE SIDED HOLSTER

CROSS-REFERENCES TO RELATED APPLICATIONS

This application claims benefit of provisional patent application 61/042,248 filed Apr. 3, 2008.

BACKGROUND OF THE INVENTION

The present invention relates generally to devices for carrying handguns. More particularly, this invention pertains to a holster for concealing a handgun while carried within an article worn by a user. As is known in the art, holsters are utilized to carry handguns. If the handgun user has the appropriate government license, a handgun user often desires to carry the handgun in a convenient place while concealing the handgun. Unfortunately, prior art holster designs are cumbersome and place a lawful handgun user at a distinct disadvantage in emergency self-defense situations.

The first problem with many prior art holster designs is that the handgun gets caught in the holster material when the handgun is being drawn. This causes the holster to be pulled out with the handgun. Cumbersome hooks and adhesive substances have been used in these holsters to prevent the holster from being pulled out when drawing the handgun but these solutions are not reliable and often do not work.

Second, prior art holster designs often do a poor job of concealing the handgun when the holster is being carried in articles worn by the user. Often, those unfamiliar and unaccustomed to handguns are intimidated and avoid social contact with the carrier. Also, if a robber or thief discovers that the user is carrying a handgun during a robbery, the thief may be more likely to use violent or even deadly tactics against the user. Finally, handgun safety is also an issue when holsters with handguns are inserted into pockets and purses. While prior art trigger retention mechanisms exist, they are often cumbersome and impractical for using in emergency situations.

What is needed, then, is a reliable and safe holster design that allows the handgun to be drawn without pulling out the holster.

BRIEF SUMMARY OF THE INVENTION

The invention provides a holster apparatus for holding a handgun which includes an outside panel having a first height, the outside panel having an inside surface and first and second lateral edges. The holster includes an inside panel having a second height less than the first height of the outside panel. The inside and outside panels have lower portions joined together and are joined together adjacent the first lateral edge of the outside panel to form a pocket adjacent the first lateral edge. A retention device is attached to the inside surface of the outside panel above the second height of the inside panel, and is spaced laterally from the first lateral edge. The retention device has an abutment surface for laterally engaging the handgun when the handgun is located in the holster in an upright position with a muzzle of the handgun received in the pocket of the holster.

In another aspect of the invention a holster is provided in combination with a handgun. The holster includes a taller side and a shorter side forming a shallow bottom pocket for receiving a muzzle of the handgun with the handgun in an upright position with the body and grip of the handgun extending above the pocket. A resilient retention plug is attached to an inside surface of the taller side and located to be received inside a trigger guard of the handgun to hold the handgun in the upright position engaging the taller side of the holster. The taller side of the holster has a height and width sufficient to completely cover the handgun.

Numerous objects, features and advantages of the present invention will be readily apparent to those skilled in the art upon a reading of the following disclosure when taken in conjunction with the accompanying drawings.

DETAILED DESCRIPTION OF THE INVENTION

Figure 1A:
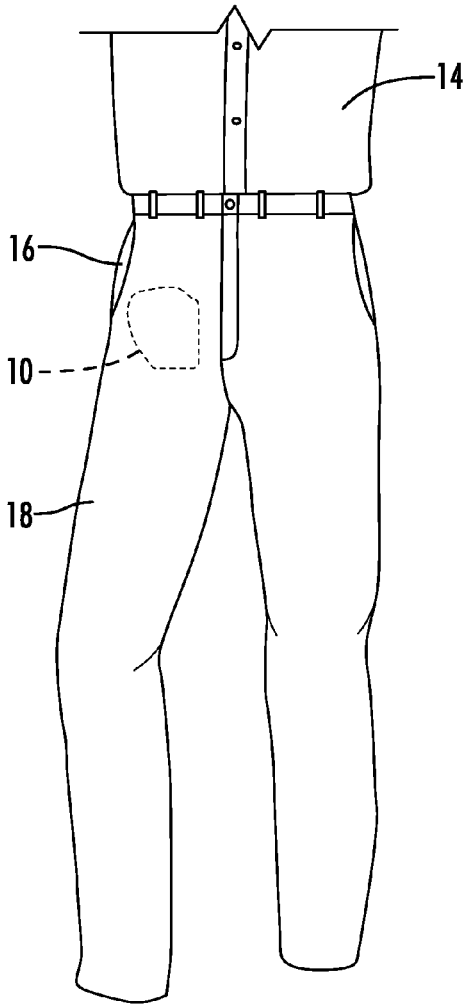
FIG. 1A is a front view of a user with the holster of the present invention concealed in their right front pants pocket. The location of the holster is shown in dashed lines.
Figure 1B:
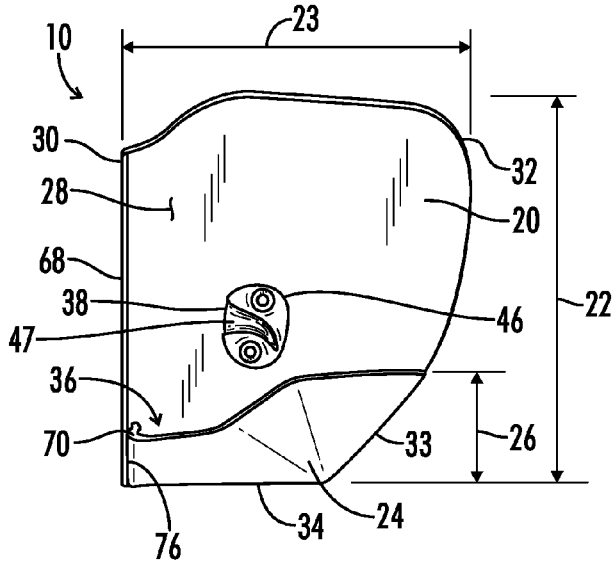
FIG. 1B is an inside elevation view of a first embodiment of the holster.
Figure 1C:
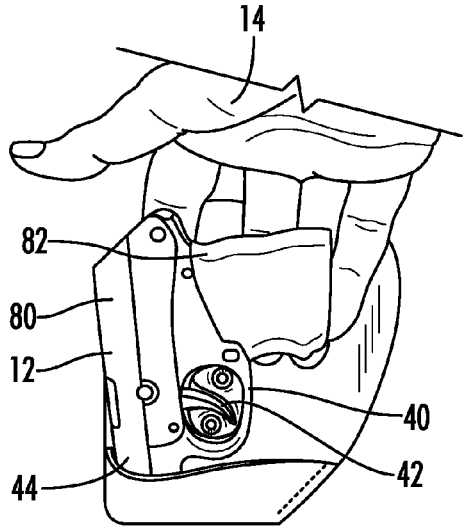
FIG. 1C shows the holster of FIG. 1B with a handgun in place therein and a user's hand inserted between the handgun and the holster in the process of removing the handgun from the holster.

The Embodiment of FIGS. 1A-1C

Referring now to the drawings and particularly to FIGS. 1B and 1C, a first embodiment of a holster apparatus is shown and generally designated by the numeral 10. FIG. 1B is an inside elevation view of the apparatus 10. FIG. 1C shows a handgun 12 being removed from the apparatus 10 by a user 14.

In FIG. 1A a front elevation view is shown of the user 14 and the location of the holster apparatus 10 within the right front pocket 16 of the user's clothing, in this case a pair of pants 18, is shown in dashed lines.

The apparatus 10 includes an outside panel 20 having a first height 22 and an inside panel 24 having a second height 26. The second height 26 is less than the first height 22, and preferably is less than one-half the first height 22.

Figure 4:
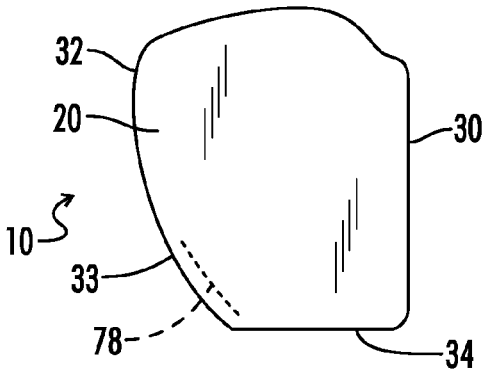
FIG. 4 is an outside elevation view of the holster of FIG. 1B.

The outside panel 20 further has an inside surface 28 and first and second lateral edges 30 and 32. As is seen in FIG. 1B, the first lateral edge 30 is straight and a lower portion 33 of the second lateral edge 32 is curved so that the holster 10 will snugly fit in the front pants pocket 16 of a typical pair of pants 18 such as blue jeans. FIG. 4 shows an outside elevation view of the holster 10. The inside and outside panels 24 and 20 are joined together along a lower edge 34 of the holster and adjacent the first lateral edge 30 to form a pocket 36 adjacent the first lateral edge 30. A retention device 38 is attached to the inside surface 28 of outside panel 20 above the second height 26 of the inside panel 24 and spaced laterally from the first lateral edge 30. The attachment of device 38 to surface 28 may be by gluing, riveting or any other suitable means. While the use of retention device 38 is preferred, in some versions of the holster it may be deleted.

In this embodiment the retention device 38 is a somewhat rounded block of resilient material shaped to fit closely within a trigger guard 40 of handgun 12 and to fit closely about a trigger 42 of handgun 12. The retention device 38 is a generally rounded block which can be described as having multiple abutment surfaces for laterally engaging the handgun 12 when the handgun 12 is located in the holster 10 in an upright position with a muzzle 44 of the handgun 12 received in the pocket 36.

Figure 3A:
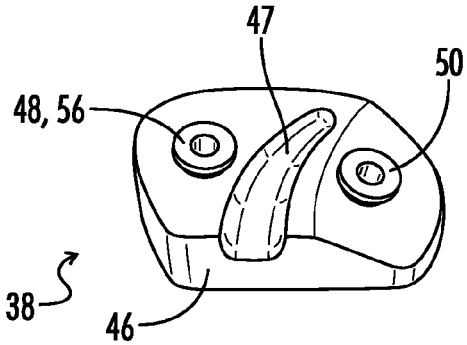
FIG. 3A is a perspective view of the resilient retention device utilized with the holsters of FIGS. 1 and 2. In the view of FIG. 3A two adjustment screws are shown in a partially extended position.
Figure 3B:
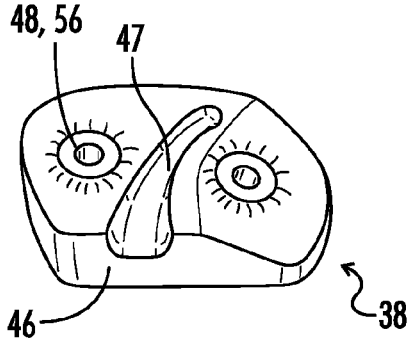
FIG. 3B is a view similar to FIG. 3A with the two adjustment screws having been tightened to compress the retention block so that a channel for receiving a trigger has been narrowed.

As is best seen in FIGS. 3A and 3B, a first one of the abutment surfaces is a peripheral abutment surface 46 extending around the periphery of the resilient block 38 which snugly engages the inner circumference of the trigger guard 40. A second one of the abutment surfaces is a channel 47 shaped and sized to closely receive the trigger 42 to snugly engage the trigger 42. When the handgun 12 is received in the holster 10 in an upright position with the retention device 38 snugly received within the trigger guard 40 and about the trigger 42, the frictional engagement of the resilient retention block 38 with the handgun 12 plus the engagement of the muzzle 44 of the handgun 12 within the pocket 36 aids in holding the handgun 12 in place within the holster 10, particularly when the holster 10 has been placed within a confining enclosure of the user's clothes such as within the pocket 16 of the user's pants 18 as shown in FIG. 1A. Additionally the retention block 38 provides a safety feature since now the trigger is not able to move in any direction when the handgun 12 is received in the holster 10. Alternatively the retention block may be shaped to engage the outside of the trigger guard 40.

The resilient retention device 38 may for example be constructed of rubber, soft plastics, injection molded self skinning rubber foam and various other materials that will fill the gaps in and around the trigger guard in a way that will cause resistance.

The details of construction of the retention device 38 are best shown in FIGS. 3A and 3B. As is thereshown the resilient retention device may include first and second compression members 48 and 50 for compressing the resilient block 38 to laterally expand the same and thus to adjust the frictional engagement of the retention block 38 with the handgun 12. By adjusting the resilient engagement of the resilient device 38 with the trigger guard of the handgun 12 this adjusts the amount of energy needed to free the handgun 12 from the holster 10. The resilient block 38 may also be used without the compression members 48 and 50.

Figure 8:
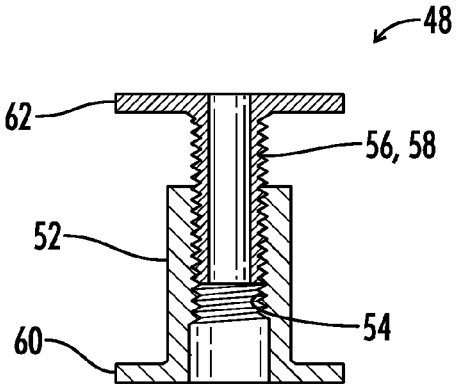
FIG. 8 is an elevation sectioned view of one of the compression rivets used with the retention block of FIGS. 3A and 3B.

The compression devices 48 and 50 may for example be adjustable screw type rivet nuts, an example of which is illustrated in FIG. 8. In FIG. 8 the compression device 48 is shown to have a body portion 52 having an internal thread 54 and a head portion 56 having an external thread 58 received in the internal thread 54. Body portion 52 has a lower flange 60 and head portion 56 has an upper flange 62. As the head portion 56 is rotated it is drawn into the body portion 52 thus drawing the flanges 60 and 62 closer to each other and compressing the material of the resilient block 38 therebetween. As the block 38 is compressed by the compression devices 48 and 50 it causes the retention block 38 to expand in a lateral direction thus expanding the perimeter abutment surface 46 and somewhat narrowing the channel 47, so that the retention device 38 will more snugly engage the handgun 12. Preferably the retention device 38 using the compression devices will be adjusted in the factory when the holster is manufactured, and the desired position of the compression devices will be fixed through the use of an adhesive such as Lock Tite Blue.

Figure 5:
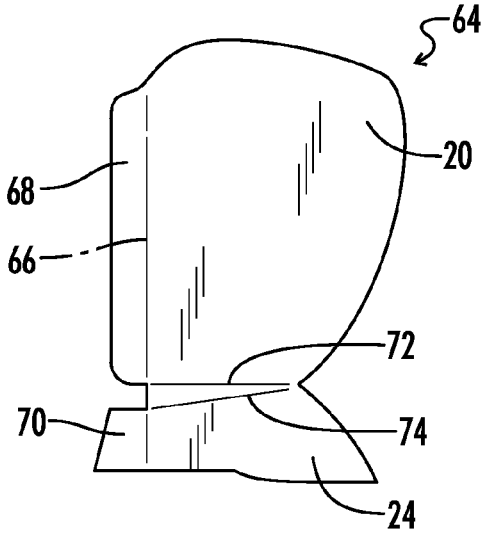
FIG. 5 is an inside elevation view of a pattern of leather or other material that has been cut and prior to folding the same into its final orientation to form the holster of FIG. 1B.

FIG. 5 shows a laid out view of a piece of material 64, such as leather, from which the holster 10 can be manufactured. In FIG. 5 the front panel 20 and 24 are identified as integral portions of the piece of material 64. A phantom line 66 identifies the general location of the first lateral edge 30 and relative to phantom line 66 are flap portions 68 and 70 which are used to join the outside panel 20 and inside panel 24 along the first lateral edge 30 and to form the pocket 36. Further phantom lines 72 and 74 show where the piece of material 64 will be bent to aid in defining the bottom portion of the pocket 36 and the general area of the lower edge 34 of holster 10.

To form the holster 10 from the piece of material 64, the inside panel 24 is folded up to the location like that of FIG. 1B, with the material being bent along the general vicinity of fold lines 72 and 74. The flaps 70 and 68 are folded inward to the location generally like that shown in FIG. 1B. The flaps 68 and 70 are joined together in the general vicinity 76 (see FIG. 1B) such as by gluing or stitching along the second lateral edge 32. The inner panel 24 is joined to outer panel 20 such as by stitching at 78 as seen in FIG. 4.

For example, when the material 64 is leather, the holster apparatus 10 can be formed by cutting the leather to shape and then using water or another substance to wet the leather. A pistol or a dummy mold in the shape of a pistol is then used to mold the leather to closely fit the shape of the specific model of pistol with which the holster is to be used. After the drying time has been completed the resulting pocket 36 is in the general shape of the muzzle 44 of the pistol thus creating a substantially perfect fit of the handgun 12 within the holster apparatus 10. Thus the specific model of handgun 12 will substantially perfectly fit within the pocket 36 of the apparatus 10. Slightly different versions of the holster apparatus 10 can thus be custom manufactured for any specific handgun 12 with which the holster 10 is to be used.

As noted, the material 64 in one embodiment is leather. Other suitable material 64 such as manmade relatively rigid fabrics could be used. The holster could also be injection molded from plastic. In general, the material from which the outside panel 20 is formed can be described as being a material being rigid enough to substantially prevent a profile of the handgun 12 from showing through the outside panel 20 when the handgun 12 is received in the holster 10 and when the holster 10 is in place within the user's clothing such as in the pocket 16 as seen in FIG. 1A.

The holster 10 can be described as an open sided holster having a taller side 20 and a shorter side 24, and having the shallow bottom pocket 36 for receiving the muzzle 44 of handgun 12 in an upright position with a body 80 and grip 82 of the handgun extending above the pocket 36 and with the resilient retention plug 38 attached to the taller side 20 and located to be received inside the trigger guard 40 of the handgun 12 to hold the handgun 12 in the upright position engaging the taller side 20 of the holster. The taller side 20 of the holster 10 has a height 22 and a width 23 sufficient to substantially completely cover the handgun 12.

Figure 2A:
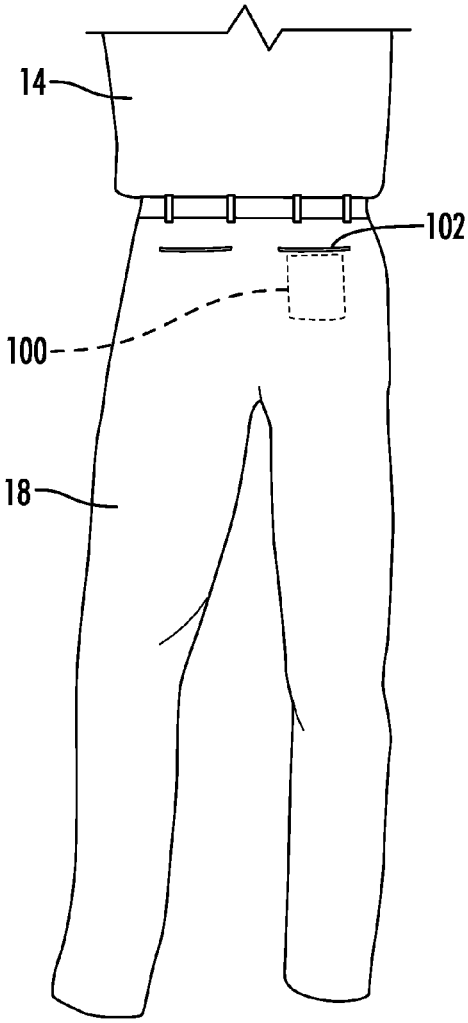
FIG. 2A is a rear view of a user showing a second embodiment of the holster carried in the user's right rear pants pocket, with the holster location shown in dashed lines.
Figure 2B:
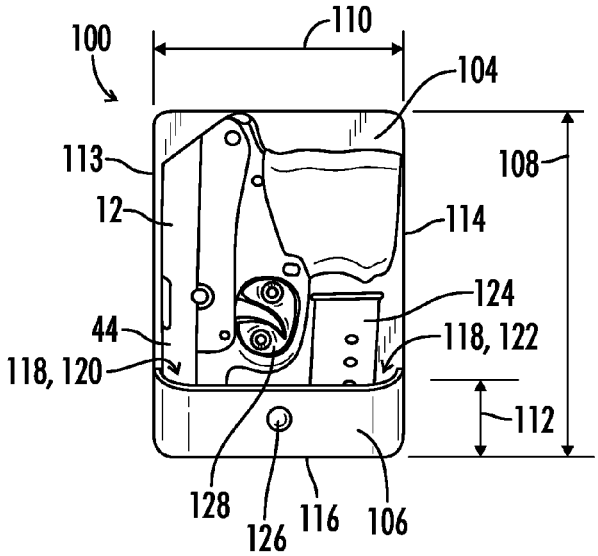
FIG. 2B is an inside view of a second embodiment of the holster designed for being carried in a back pants pocket as shown in FIG. 2A. In the view of FIG. 2B a handgun is within the holster.
Figure 2C:
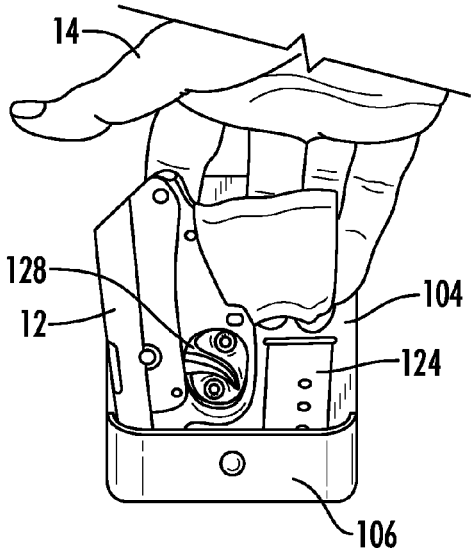
FIG. 2C is a view of the holster with a handgun in place therein and a user's hand inserted between the handgun and the holster in the process of removing the handgun from the holster.

The Embodiment of FIGS. 2A-2C

Referring now to FIGS. 2A-2C, a second embodiment of the holster apparatus is shown and generally designated by the numeral 100. The holster apparatus 100 is similar to the apparatus 10, but has a somewhat different peripheral shape so that it may better fit in a different shape pocket such as a more rectangular rear pocket 102 of the user's pants 18 as shown in FIG. 2A.

The holster 100 includes an outside panel 104 and an inside panel 106. The outside panel 104 has a height 108 and a width 110. The inside panel 106 has a second height 112 which is less than the first height 108.

The outside panel 104 has first and second lateral edges 113 and 114 both of which are generally straight and generally parallel to each other thus giving the holster 100 a generally rectangular shape which will snugly fit in a typical generally rectangular back pants pocket 102. As is seen in FIGS. 2B and 2C the widths 110 of both the outside panel 104 and inside panel 106 are substantially equal. The inside panel 106 is joined to the outside panel 104 along a bottom edge 116 and the first and second lateral edges 113 and 114 to form a shallow pocket 118. The pocket 118 of holster 100 is somewhat differently shaped from the pocket 36 of holster 10 because of the different overall perimeter shape of the holster 100. Thus the pocket 118 is wider than was the pocket 36 and it has a first pocket portion 120 which receives the muzzle 44 of handgun 12, and a second pocket portion 122 which receives an ammunition magazine 124 for the handgun 12. A rivet 126 or the like may separate the first and second pocket portions 120 and 122.

The holster 100 includes a resilient retention block 128 designed substantially identical to the resilient retention block 38 previously described for the holster 10.

The holster 100 may, in a fashion similar to the holster 10, be formed from a single piece of material such as a piece of leather, so that the outer panel 104 and inner panel 106 are integrally joined together along bottom edge 116 simply by folding the piece of material from which they are formed. Again, the material may be leather, or it may be other suitable material as previously described.

Figure 6:
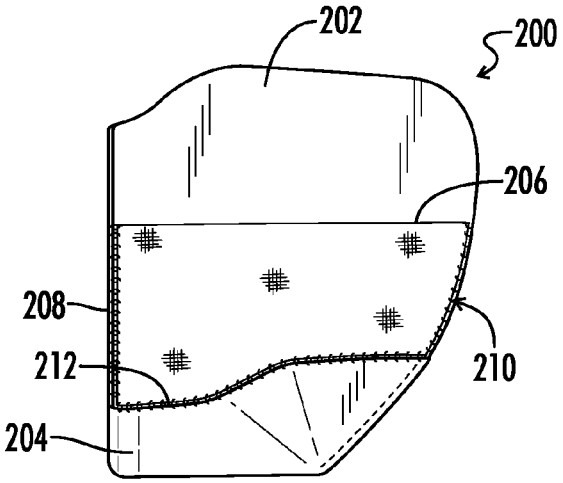
FIG. 6 is an inside elevation view of a holster similar to that of FIG. 1B, but including an upper strip of elastic material above the inside panel to aid in holding a handgun in place.
Figure 7:
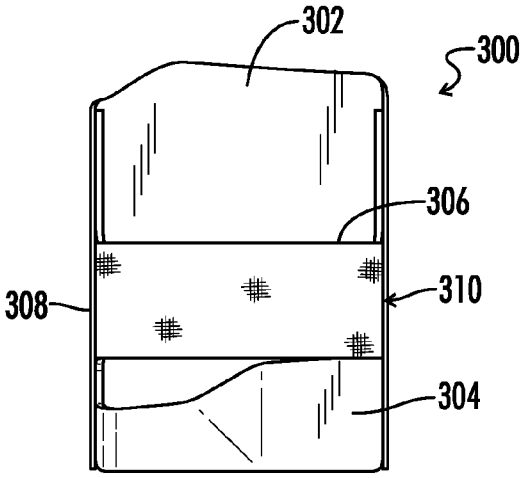
FIG. 7 is an inside elevation view of a holster similar to that of FIG. 2B having an elastic panel above the shorter inside panel to aid in holding a handgun in place.

The Embodiments of FIGS. 6 and 7

As previously noted, the apparatus 10 and 100 are particularly designed for carrying within a front or rear pants pocket, respectively. When so carried, the receipt of the muzzle 44 within the shallow pocket of the holster and the frictional engagement of the trigger guard of the handgun 12 by the resilient retention block 38 or 128, plus the tight confines of the combination of the handgun 12 and the holster apparatus 10 or 100 within the user's pocket all serve to hold the handgun 12 in place within the holster apparatus within the user's pocket.

If, however, the user desires to carry the holster and handgun in another article being worn by the user such as a woman's purse or a backpack being carried by the user, modified designs may be preferable. For example, a holster similar to the holster 10 in shape, but having modified design for use in a woman's purse is shown in FIG. 6 and generally designated by the numeral 200. The holster apparatus 200 has an outside panel 202 and an inside panel 204 constructed generally identically to the analogous structures of the holster apparatus 10 of FIGS. 1A-1C. Additionally, the holster apparatus 200 includes a resilient inside cover 206 located above the inside panel 204 and attached to the outside panel 202 along first and second lateral edges 208 and 210 thereof. The resilient cover 206 may for example be an elastic material. The resilient cover 206 may be attached to the holster 200 adjacent the first and second lateral edges 208 and 210 by stitching, gluing or any other suitable means. Optionally, the resilient cover 206 can also be attached to an upper edge 212 of inside panel 204 by stitching, gluing or other suitable process.

With the apparatus 200, the resilient retention device 38 is optional and may be included or may be deleted.

With the holster apparatus 200, the resilient cover 206 aids in holding the handgun 12 in place within the holster apparatus 200 when the holster apparatus 200 is received within the looser confines of a woman's purse. Additionally, the cover 206 aids in keeping debris out of the pocket of the holster, and in preventing engagement of the trigger of the handgun 12 by other articles in the woman's purse or the like.

FIG. 7 shows a still further construction of the holster apparatus designated by the numeral 300. The holster apparatus 300 is similar in shape to the apparatus 100 of FIGS. 2A-2B, except that once again it is designed for use in a woman's purse or other article rather than in the tight confines of a pants pocket. Once again, the holster apparatus 300 includes an outside panel 302 and an inside panel 304. The outside panel 302 and inside panel 304 are constructed in a manner generally similar to that of the holster apparatus 100 of FIGS. 2B and 2C. Again, an elastic cover 306 has been added which is attached to the outside panel 302 along first and second lateral edges 308 and 310 thereof.

The holster apparatus 300, having the more rectangular shape like that of apparatus 100 provides room for carrying both a handgun 12 and an ammunition magazine 124 in a manner similar to that shown in FIG. 2B for the apparatus 100.

The resilient material from which the cover 206 of FIG. 6 or 306 of FIG. 7 are constructed is more flexible than the relatively rigid material from which the outer panels 202 and 302 are constructed. The relatively resilient material of covers 206 and 306 aid in holding the handgun 12 in place within their respective holster apparatus, and may be used either in combination with a resilient retention block such as 38 or without such a resilient retention block.

In still other embodiments, a belt clip mechanism (not shown) could be added to the holster 10 or 100 to position the holster inside the waistband by attaching the belt clip to the edge of the belt or pants. This belt clip would extend from the outside panel such as 104 of the holster apparatus 100.

Manner of Use

In use, the holster 10, which can be generally described as an open sided holster, works well when it is held in the close confines of a pocket of the user's pants. Even though the holster 10 is generally open sided above the shorter inside panel, the combination of the retention block 38 and the receipt of the holster 10 and handgun 12 within the close confines of a pocket such as 16 provides the security needed for the handgun 12 to stay in place within the holster 10 with the inside of the holster primarily open.

The manner of use of a holster apparatus such as 10 or 100 when confined within a pants pocket is best illustrated with regard to FIGS. 2B and 2C. In FIG. 2B the holster 100 is illustrated having the handgun 12 in place therein in an upright position in close engagement with the resilient retention block 128 as it would be when closely received within the back pocket of the user's pants. To draw the pistol, the user 14 merely slips the fingers of his hand between the outside panel 104 and grip of the handgun 12 as shown in FIG. 2C which pushes the handgun 12 away from the outside panel 104 and out of engagement with the retention block 128 and allows the handgun 12 to be drawn free from the holster 100 out of the pocket 102. Once the handgun 12 gains a few degrees of angle of tilt away from the outside panel 20 it is free of the retention block 38 and may be withdrawn out of the user's pocket leaving the holster in place so that there is no chance of the retention block 38 getting in the way or fouling up the draw of the handgun 12. The holster 100 will be retained within the pocket 102 due to its snug engagement with the pocket 102 and the handgun 12 can be cleanly withdrawn from the shallow pocket 118 of the holster 100. To reholster the handgun, the holster is removed from the pocket, the handgun is replaced within the holster, and then the combination handgun and holster is inserted back into the pocket.

While the handgun 12 is stored within the holster 100 within the pocket 102 of the user's pants 18 the fact that the muzzle 44 rests in a completely enclosed shallow pocket 118 of the holster 100 prevents any debris from inside the user's pants pocket 102 from being able to enter the handgun 12 to dirty or foul the mechanisms of the handgun 12. Also, since the outer panel 104 completely covers the handgun 12 so that the profile of the handgun 12 is not visible through the relatively rigid material of the outside panel 104, the combination of the handgun 12 and holster apparatus 100 when received in the back pants pocket 102 of the user's pants 18 creates the general impression simply of a wallet carried in the user's pants pocket. The same is true when using the apparatus 10 carried in the front pants pocket. The handgun 12 and holster apparatus 100 when carried in the user's pants pocket such as shown in FIG. 2A simply shows as a smooth, relatively square object such as a wallet to the casual onlooker. Two specific shapes have been shown in FIGS. 1A-1C and FIGS. 2A-2C to conform to the typical profiles of front and rear pockets, respectively, of men's jeans. Other shaped holsters could be provided for receipt in pockets or openings of other articles of clothing or articles such as purses, backpacks or the like which are worn or carried by a user.

Thus, although there have been described particular embodiments of a new and useful One Sided Holster it is not intended that such references be construed as limitations upon the scope of this invention except as set forth in the following claims.

What is claimed is:

1. A holster apparatus for holding a handgun in a user's pocket, comprising:

an outside panel having a first height, a width, an inside surface and first and second lateral edges, wherein the first height and the width are greater than a corresponding height and width of the handgun;

an inside panel having a second height less than the first height of the outside panel, the inside and outside panels being joined together adjacent the first lateral edge of the outside panel and along a lower edge of the holster to form a pocket adjacent the first lateral edge, wherein said pocket formed adjacent the first lateral edge is operable to receive a muzzle of the handgun, wherein the inside panel is between the outside panel and the user if the holster apparatus is holding the handgun in the user's pocket; and a retention device attached to the inside surface of the outside panel above the second height of the inside panel and spaced laterally from the first lateral edge, wherein the retention device is a retention block having an abutment surface for engaging an inside surface of a trigger guard of the handgun and a channel configured to receive a trigger of the handgun when the handgun is located in the holster in an upright position with a muzzle of the handgun received in the pocket.

2. The apparatus of claim 1, wherein:

the second height is less than one-half the first height.

3. The apparatus of claim 1, wherein:

the abutment surface of the retention device comprises the channel for receiving the trigger of the handgun.

4. The apparatus of claim 1, wherein:

the abutment surface of the retention device comprises a peripheral abutment surface for engaging an inside of the trigger guard of the handgun.

5. The apparatus of claim 1, wherein the retention device comprises a resilient block.

6. The apparatus of claim 5, wherein the retention device further comprises a compression member for compressing the resilient block to laterally expand the resilient block.

7. The apparatus of claim 1, wherein:

the first lateral edge is straight and a lower portion of the second lateral edge is curved so that the holster will fit in a front pants pocket.

8. The apparatus of claim 1, wherein:

the first and second lateral edges are straight and generally parallel to each other so that the holster will fit in a back pants pocket.

9. The apparatus of claim 8, wherein:

the inside panel and the outside panel are substantially equal in width and the inside panel forms a second pocket adjacent the second lateral edge for holding an ammunition magazine.

10. The apparatus of claim 1, wherein:

the outside panel is formed of a material rigid enough to substantially prevent the profile of the handgun from showing through the outside panel when the handgun is received in the holster.

11. The apparatus of claim 10, wherein the material is leather.

12. The apparatus of claim 10, wherein the holster is open above the inside panel.

13. The apparatus of claim 10, further comprising:

an inside resilient cover located above the inside panel and attached to the outside panel adjacent the first and second lateral edges of the outside panel.

14. The apparatus of claim 1, wherein:

the inside and outside panels comprise a single piece of leather folded to form a bottom edge of the holster.

15. A holster apparatus for holding a handgun in a user's pocket, comprising:

an outside panel having a first height, a width, and an inside surface;

an inside panel having a second height less than the first height, the inside panel being attached to the outside panel along at least a lower edge of each and a first lateral edge of each to form a pocket for receiving a muzzle of a handgun, wherein the inside panel is between the outside panel and the user when the holster is holding the handgun in the user's pocket;

a retention device comprising a resilient block attached to the inside surface of the outside panel above the inside panel and laterally spaced from the first lateral edge, wherein an abutment surface of the resilient block abuts and frictionally engages an inside surface of an inner circumference of a trigger guard of the handgun and a posterior surface of a trigger of the handgun when the handgun is located in the holster in an upright position with the muzzle of the handgun received in the pocket;

wherein the outside panel is formed of a material rigid enough to substantially prevent the profile of the handgun from showing through the outside panel when the holster is holding the handgun.

16. A holster apparatus for holding a handgun, comprising:

an outside panel having a first height, the outside panel having an inside surface, first and second lateral edges, and a lower edge;

an inside panel having a second height less than the first height of the outside panel, the inside and outside panels being joined together adjacent the first lateral edge of the outside panel and along the lower edge of the outside panel to form a pocket adjacent the first lateral edge, between the inside panel and the outside panel;

a retention device attached to the inside surface of the outside panel above the second height of the inside panel and spaced laterally from the first lateral edge, the retention device having an abutment surface for engaging a trigger guard of the handgun when the handgun is located in the holster in an upright position with a muzzle of the handgun received in the pocket; and an elastic cover located at least partially above an upper edge of the inside panel and attached to the outside panel adjacent the first and second lateral edges of the outside panel.

17. A holster apparatus for retaining a handgun, the handgun having a trigger guard defining a trigger guard interior space, the handgun having a trigger extending into the trigger guard interior space, the holster apparatus comprising:

an outer panel having a first height, an outer panel upper edge and an outer panel lateral edge;

an inner panel having a second height less than the first height of the outer panel, an inner panel upper edge, and an inner panel lateral edge, wherein the inner panel lateral edge is substantially co-extensive with the outer panel lateral edge;

a pocket defined between the inner and outer panels, wherein the pocket is shaped to at least partially receive a muzzle of the handgun;

a resilient retention block protruding from the outer panel generally toward the inner panel, wherein the retention block is attached to the outer panel at a location above the inner panel upper edge and below the outer panel upper edge and spaced from the outer panel lateral edge; and a channel defined in the retention block, the channel shaped to at least partially receive the trigger when the handgun is received in the pocket and the retention block is in the trigger guard interior space.

18. The apparatus of claim 17, wherein:

the retention block comprises an abutment surface operable to abut and frictionally engage an inside surface of the trigger guard and a posterior surface of the trigger simultaneously while the handgun is received in the pocket and the trigger is received in the channel.

19. The apparatus of claim 17, wherein:

the retention block is dimensioned to abut and frictionally engage an inside surface of the trigger guard and a posterior surface of the trigger while the handgun is received in the pocket and the trigger is received in the channel.

20. The apparatus of claim 17, wherein:

the retention block is dimensioned to substantially fill a gap between the trigger and the trigger guard, and frictionally engage a posterior surface of the trigger and an inside surface of an inner circumference of the trigger guard when the handgun is received in the pocket and the trigger is received in the channel.

21. The apparatus of claim 17, wherein:

a lower edge of the retention block protrudes from the outer panel less than an edge of the retention block adjacent the channel such that the handgun can be withdrawn from the holster apparatus when the handgun is removed from frictional engagement with the retention block and tilted away from the outside panel.

* * * * *